US007845641B2

(12) United States Patent
Miller et al.

(10) Patent No.: US 7,845,641 B2
(45) Date of Patent: Dec. 7, 2010

(54) PRESS-YOUR-LUCK CHALLENGE

(75) Inventors: John Miller, Seattle, WA (US); Jason York, Bellevue, WA (US); Benjamin Ellinger, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 141 days.

(21) Appl. No.: 12/250,414

(22) Filed: Oct. 13, 2008

(65) Prior Publication Data

US 2010/0090403 A1 Apr. 15, 2010

(51) Int. Cl.
*A63F 1/00* (2006.01)
*A63F 13/00* (2006.01)

(52) U.S. Cl. ..... 273/292; 273/274; 463/11

(58) Field of Classification Search ..... 273/292, 273/274, 309; 463/11–13
See application file for complete search history.

(56) References Cited

U.S. PATENT DOCUMENTS

| | | | | |
|---|---|---|---|---|
| 4,138,119 | A | 2/1979 | Brannon | |
| 5,022,653 | A * | 6/1991 | Suttle et al. | 463/13 |
| 5,954,331 | A | 9/1999 | Hepburn | |
| 6,179,291 | B1 | 1/2001 | Vancura | |
| 6,179,711 | B1 * | 1/2001 | Yoseloff | 463/25 |
| 6,182,968 | B1 | 2/2001 | Wilkinson | |
| 6,325,375 | B1 | 12/2001 | Potter et al. | |
| 6,845,981 | B1 | 1/2005 | Ko | |
| 2002/0187823 | A1 | 12/2002 | Khal | |
| 2006/0276242 | A1 * | 12/2006 | Thomas et al. | 463/11 |
| 2008/0061506 | A1 | 3/2008 | Byrne et al. | |
| 2008/0150232 | A1 | 6/2008 | Deza et al. | |

OTHER PUBLICATIONS

"'Fortune's Tower", http://mycheats.1up.com/view/section/3168407/24300/fable_2_pub_games/game.
"Pre-E3 2008: Fable II Pub Games Hands-On", http://xboxlive.ign.com/articles/886/886945p2.htmI.
"The Rules of Video Poker", http://bewestluck.com/faq2d.php.

* cited by examiner

*Primary Examiner*—Benjamin H Layno
(74) *Attorney, Agent, or Firm*—Alleman Hall McCoy Russell & Tuttle LLP

(57) ABSTRACT

A method of hosting a press-your-luck challenge includes receiving a stake from a player and iteratively beginning phases of the press-your-luck challenge. Each phase of the press-your-luck challenge comprises dealing an active subset of game items from a set of game items. If the active subset of game items is defeated by an immediately previous subset of game items, the press-your-luck challenge is ended. If the active subset of game items is not defeated by an immediately previous subset of game items, the player is offered a return equal to a total value of the active subset of game items. If the player accepts the return, the player is awarded the return and the press-your-luck challenge ends. If the player declines the return, a subsequent phase of the press-your-luck challenge is begun.

20 Claims, 4 Drawing Sheets

PRESS-YOUR-LUCK CHALLENGE

BACKGROUND

Many people enjoy playing games that include some aspects of luck and some aspects of skill. Such games can be played for fun, with nothing on the line. However, such games are often played with a player staking a bet in hopes of winning cash or another prize.

SUMMARY

A press-your-luck challenge is disclosed. The press-your-luck challenge may include one or more phases depending on the luck of the draw and the choices made by a player. In each phase, it is determined if an active subset of game items is defeated by an immediately previous subset of game items. If the active subset of game items is not defeated by the immediately previous subset of game items, a player is offered a choice to accept a return or begin another phase of the challenge in hopes of winning a larger return. If the active subset of game items is defeated by the immediately previous subset of game items, the player loses and the challenge ends.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
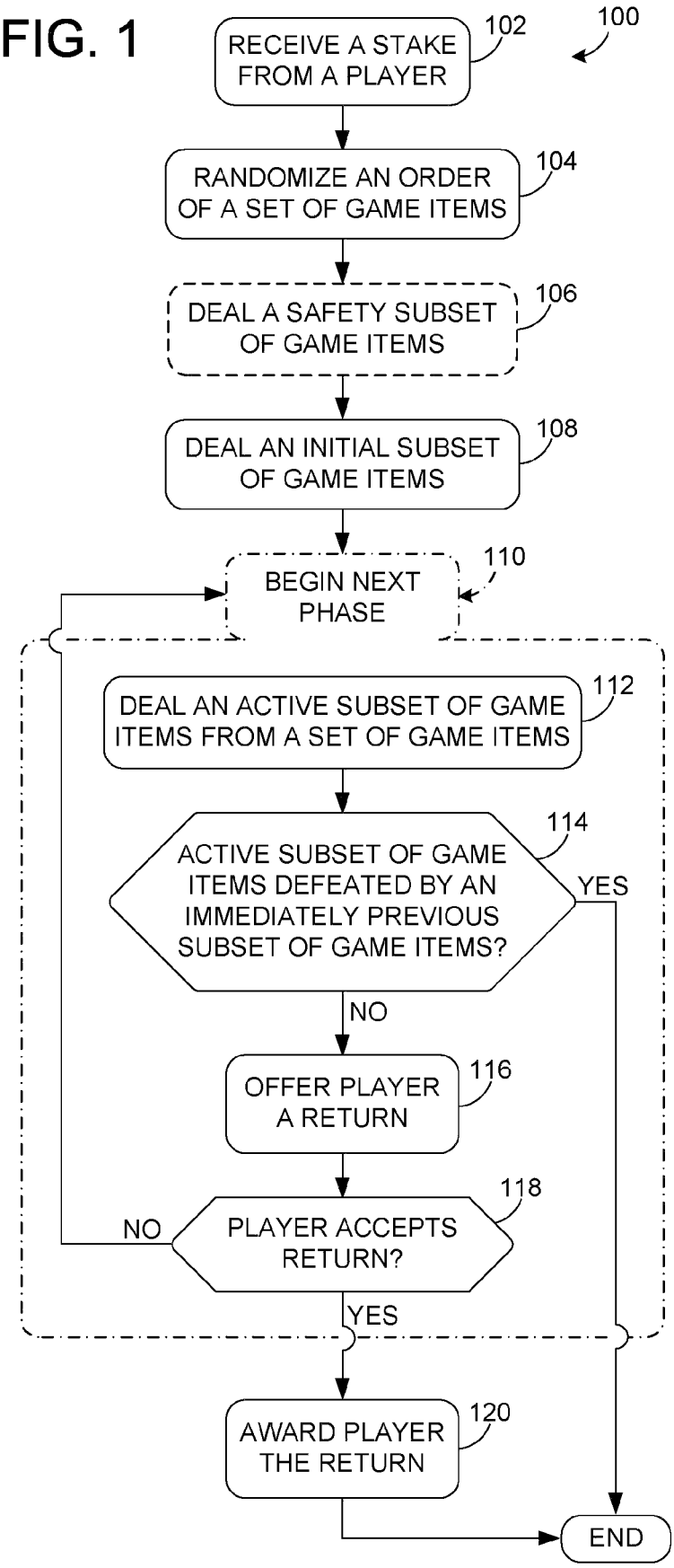
FIG. 1 shows a process flow of an example method of hosting a press-your-luck challenge.

FIG. 1 shows a process flow of an example method 100 of hosting a press-your-luck challenge. A press-your-luck challenge can be hosted in a variety of different manners without departing from the scope of this disclosure. In some embodiments, a press-your-luck challenge can be hosted as a live press-your-luck card game, analogous to a live game of blackjack hosted at a casino. In other embodiments, a press-your-luck challenge can be hosted as a video press-your-luck challenge, analogous to a video-poker game in a casino. In still other embodiments, a press-your-luck challenge can be hosted as a game played on a computing device, such as a personal computer, console gaming machine, portable gaming machine, personal data assistant, mobile communications device, or any other suitable computing device. When hosted on a computing device, the press-your-luck challenge can be served from a remote server or executed from locally saved instructions. Further, in some embodiments, a press-your-luck challenge can be a game within a game—such as a card game that can be played by gaming characters existing in a virtual game world.

At 102, method 100 includes receiving a stake from a player. The stake may take a variety of different forms depending on the manner in which the press-your-luck challenge is being hosted. In a casino card game, the stake may take the form of a cash or cash equivalent (e.g., chips) wager. In a video-game, the stake may be a submission of one or more virtual dollars or points, which may or may not correspond to cash or other value outside of the game. In some embodiments, the initial stake may simply be acceptance by a player to play the game. As explained in more detail below, a particular amount (e.g., 15 dollars or points) may be set as a base stake, and a player may be allowed to bet a different amount, in which case any return (i.e., winnings) can be adjusted proportionally to the variation from the base stake.

A press-your-luck challenge can be played with a variety of different game items. For example, a full set of game items may be a deck of physical or virtual cards. As another example, the game items may be a collection of physical or virtual tiles. As yet another example, the game items may be data stored in computer memory.

In some variations, the press-your-luck challenge can be played with a set of game items including a plurality of value items, each value item having a rank (e.g., 1, 2, 3, 4, 5, 6, and 7). The set of game items may be configured to include virtually any number of different ranks and virtually any number of different value items having each rank. As a nonlimiting example, a set of game items may have ten value items at each rank between 1 and 7 (i.e., ten 1s, ten 2s, ten 3s, etc.). Each value item has an individual value equal to the rank of that value item. For example, a game item having the rank of 4 has a value of 4 points in the press-your-luck challenge.

In some variations, a press-your-luck challenge can be played with one or more game items that are not value items. Such game items do not have a rank, and therefore, do not have individual values. Nonetheless, such game items can significantly influence the outcome of a press-your-luck challenge. Nonlimiting examples of non-value items include a savior item, a death item, a peek item, and a multiplier item, each of which is described in more detail below.

At 104, method 100 includes randomizing an order of a set of game items. As a nonlimiting example, this may include shuffling a deck of physical cards. As another nonlimiting example, this may include applying a shuffling algorithm, such as a Fisher-Yates shuffle algorithm, to an array of virtual card objects. The randomization of the game elements can be fully executed prior to dealing any game elements, and/or randomization can be executed on the fly while dealing game elements (e.g., selecting a random game element from the remaining set of game elements with each deal).

Figure 2A:
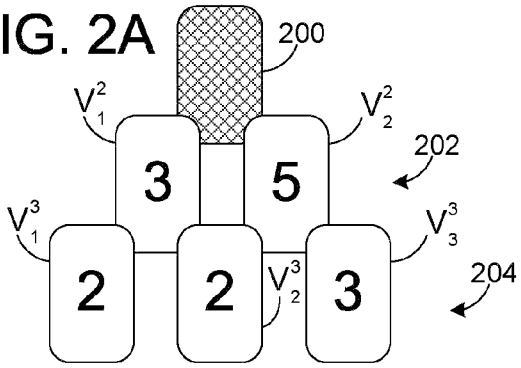
FIGS. 2A-2D show the dealing of an example press-your-luck challenge.

At 106, method 100 optionally includes dealing a safety subset of game items from the full set of game items. In some variations, the player is not provided with any safety items. When dealt, the safety subset of game items may include any desired number of safety items. Increasing the number of safety items improves the odds for the player. As a nonlimiting example, as shown in FIG. 2A, a single safety card 200 may be dealt. Safety card 200 is dealt face-down, although other variations may deal a subset of safety items that are visible to the player (e.g., cards dealt face-up).

Turning back to FIG. 1, at 108, method 100 includes dealing an initial subset of game items from the full set of game items. The initial subset of game items may include any desired number of game items depending on the variation being played. As a nonlimiting example, FIG. 2A shows an initial row 202 of two cards, namely card $V_1^2$, and card $V_2^2$. In this example, card $V_1^2$ is a value card having a rank of 3, and card $V_2^2$ is a value card having a rank of 5.

Figure 3:
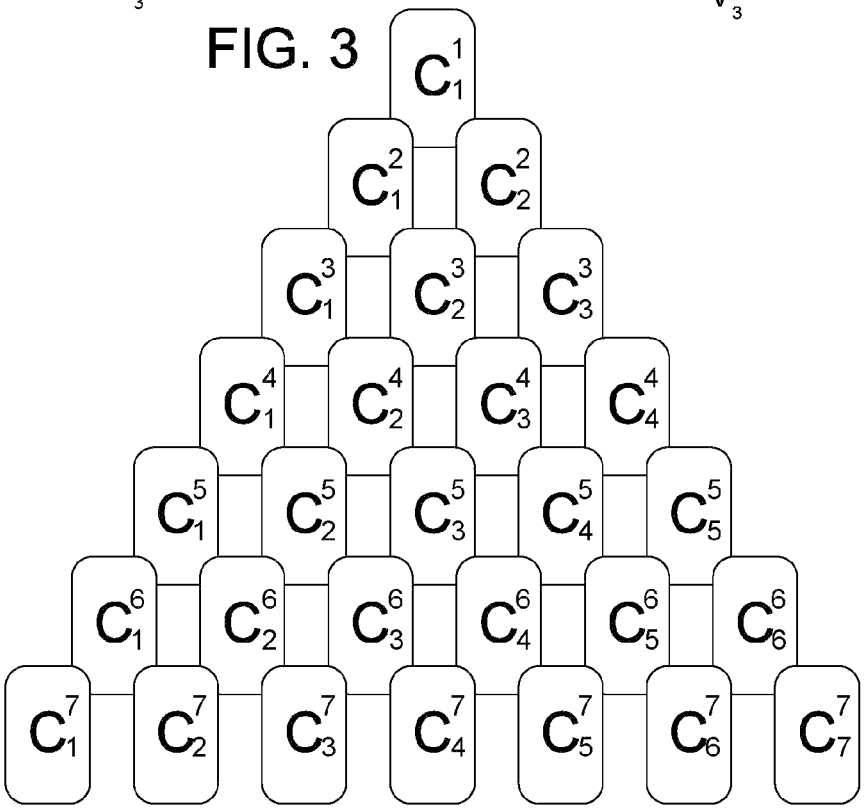
FIG. 3 shows a naming convention that can be used to refer to game items dealt in a press-your-luck challenge.

The naming convention used for cards throughout this disclosure uses a superscript to identify the card's row and a subscript to identify the card's position within the row. FIG. 3 provides a mapping of this naming convention to a card pyramid having seven rows. This naming convention is also used for game items other than cards, which may be "dealt" according to a variety of different conventions. For example, game items may be "dealt" into an array or other data structure residing in computer memory. In general, a superscript is used to identify the phase in which the game item is dealt, and a subscript is used to incrementally index each game item within that particular phase. In other words, each game item from a subset of game items is incrementally indexed in sequential order starting from the same number (e.g., 1), and the naming convention used in this disclosure uses a subscript to represent this indexing. A "V" may be used to represent a value item, an "S" is used to represent a savior item, a "D" is used to represent a death item, a "P" is used to represent a peek item, and an "M" is used to represent a multiplier item. A "C" is used to generically describe any game item, whether it be a value item or a non-value item.

Turning back to FIG. 1, at 110, method 100 includes beginning the next phase of the press-your-luck challenge. As described in detail below, the number of phases in a given press-your-luck challenge can vary depending on a player's choices and the luck of the draw. When one phase ends, subsequent phases may be iteratively begun, so that each new phase follows an immediately previous phase.

As shown at 112 of method 100, each new phase usually begins with dealing an active subset of game items from a full set of game items. However, in some variations, the first phase after an initial subset of game items is dealt may begin with offering a player a return, as shown at 116, and as is described below with reference to subsequent phases.

As a nonlimiting example of dealing an active subset of game items from a full set of game items, FIG. 2A shows an active row 204 of cards dealt from a deck of cards. In this example, card $V_1^3$ is a value card having a rank of 2, card $V_2^3$ is a value card having a rank of 2, and card $V_3^3$ is a value card having a rank of 3. It is to be understood that while this example is described in the context of dealing cards in a pyramid, any other type of dealing may be used without departing from the scope of this disclosure. For example, a computer data structure may be configured to keep track of virtual game items that are dealt in the press-your-luck challenge, even if cards or other game items are not physically dealt or virtually dealt on a graphical display.

Turning back to FIG. 1, at 114, each phase of method 100 includes determining if an active subset of game items is defeated by an immediately previous subset of game items. Several different variations of a press-your-luck challenge can be designed, each of which uses a different set of rules for determining if an active subset of game items is defeated by an immediately previous subset of game items. However, it is to be understood that press-your-luck challenges in accordance with the present disclosure include at least one comparison between at least one game item from the active subset of game items and one game item from the immediately previous subset of game items (e.g., a comparison between a card from the active row and a card from the immediately previous row).

Figure 4:
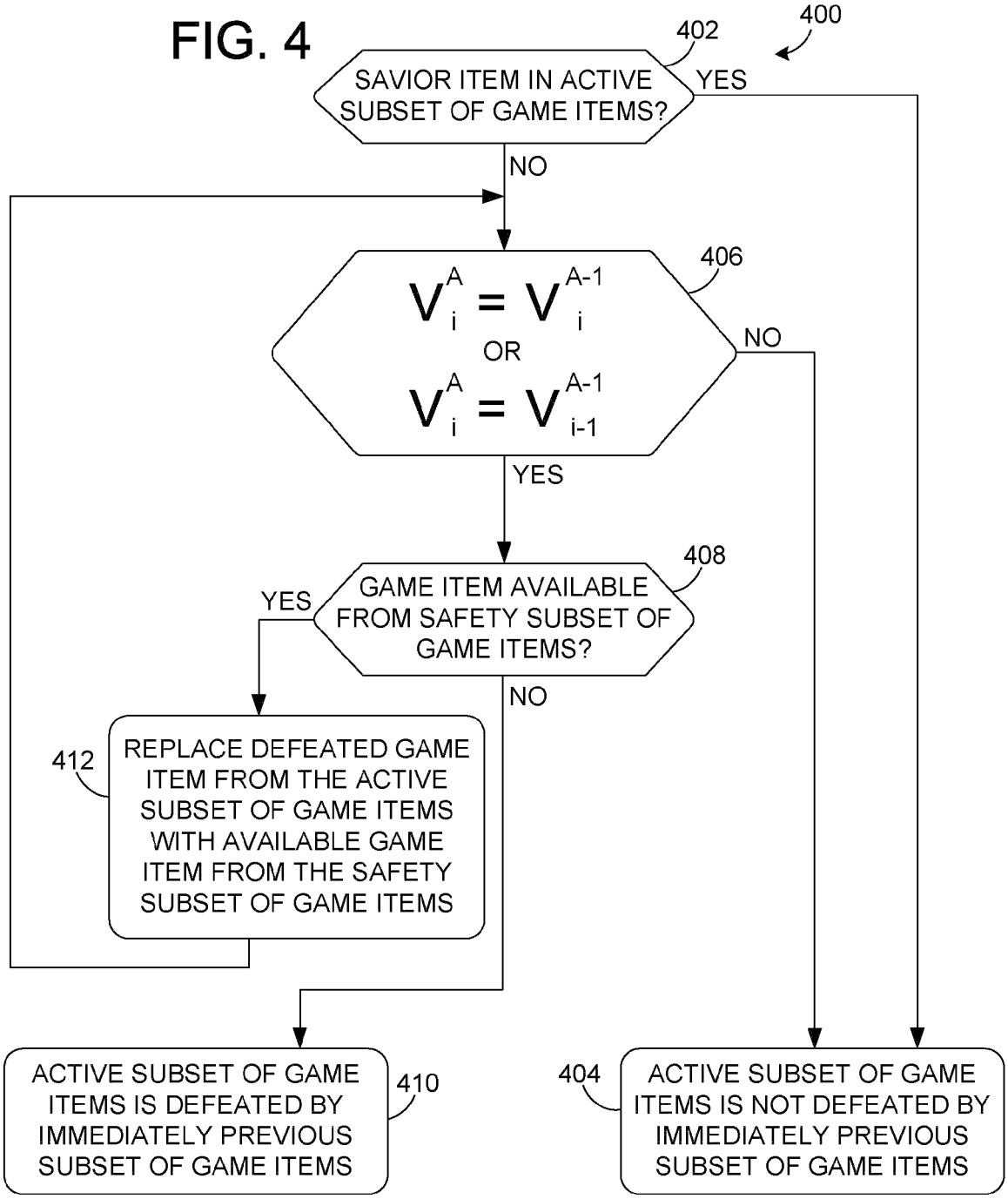
FIG. 4 shows a process flow of an example method for determining if an active subset of game items is defeated by an immediately previous subset of game items.

FIG. 4 shows a process flow of a nonlimiting example of a method 400 for determining if an active subset of game items is defeated by an immediately previous subset of game items. At 402, method 400 includes determining if a savior item is present in the active subset of game items. In some variations of the press-your-luck challenge, the full set of game items includes one or more savior items. In such variations, an active subset of game items that includes a savior item is immune from defeat. Accordingly, if the active subset of game items includes a savior item, method 400 proceeds to 404, and it is determined that the active subset of game items is not defeated by the immediately previous subset of game items. In variations that do not include at least one savior item, this step can be skipped. As discussed below, a savior item is one of several different non-value game items.

At 406, method 400 includes determining if, for any value item from the active subset of game items, that value item has a rank that is equal to a rank of a value item from an immediately previous subset of game items having an index equal-to or one-less-than an index of that value item. In other words, it is determined if:

$$V_i^A = V_i^{A-1} \text{ or } V_i^A = V_{i-1}^{A-1}$$

where V indicates a value item; A indicates the active subset of game items; (A−1) indicates the immediately previous subset of game items; and i indicates the index variable (i.e., position of the game item within its subset of game items). The index variable is varied so that all value items from the active set are tested. In other words, i is varied from 1 to n, where n is the total number of game items in the active subset.

Using FIG. 2A as an example, the following values are tested:

$V_1^A$ is 2 and $V_1^{A-1}$ is 3, so $V_1^A \neq V_1^{A-1}$;
$V_1^A$ is 2 and $V_0^{A-1}$ is null, so $V_1^A \neq V_0^{A-1}$;
$V_2^A$ is 2 and $V_2^{A-1}$ is 5, so $V_2^A \neq V_2^{A-1}$;
$V_2^A$ is 2 and $V_1^{A-1}$ is 3, so $V_2^A \neq V_1^{A-1}$;
$V_2^A$ is 3 and $V_2^{A-1}$ is null, so $V_2^A \neq V_2^{A-1}$; and
$V_2^A$ is 3 and $V_2^{A-1}$ is 5, so $V_2^A \neq V_2^{A-1}$.

If no value item from the active subset of game items has a rank that is equal to a rank of a value item from an immediately previous subset of game items having an index equal-to or one-less-than an index of that value item, then method 400 proceeds to 404, and it is determined that the active subset of game items is not defeated by the immediately previous subset of game items.

The above described testing procedure is well suited for variations of the press-your-luck challenge in which each active subset of game items includes one more game item than an immediately previous subset of game items, the same number of game items relative to the immediately previous subset of game items, or one less game item than an immediately previous subset of game items.

Figure 2B:
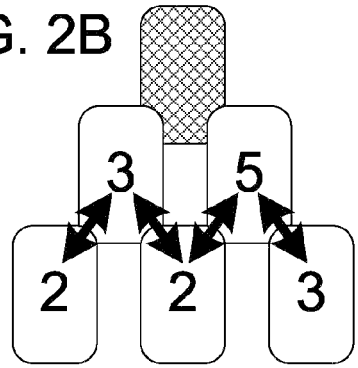

In some variations of the press-your-luck challenge, each row of cards includes one more card than an immediately previous row of cards, and the cards are dealt to form a pyramid. In such variations, the above described test can be quickly and easily performed by a visual inspection of the cards. According to the above described test, an active row of cards is defeated by an immediately previous row of cards if any card from the active row of cards has the same rank as any overlapping card from an immediately previous row of cards. The cards that are to be compared with one another are indicated by two-ended arrows in FIG. 2B. As used herein, "overlapping" means being adjacent to a game item in the immediately previous row, whether or not the adjacent game items physically touch one another or intersect one another on a graphical display.

If any value item from the active subset of game items has a rank that is equal to a rank of a value item from an immediately previous subset of game items having an index equal-to or one-less-than an index of that value item, then the active subset of game items is defeated by the immediately previous subset of game items, unless a safety item can save the active subset. These scenarios are described in more detail below.

Turning back to FIG. 1, method 100 includes, at 116, offering the player a return. In some variations, the return that is offered is equal to a total value of the active subset of game items, with a return bonus that is increased proportional to the wagered stake as compared to a base stake. The total value of the active subset of game items is a sum of the individual values for all value items from the active subset of game items. Using FIG. 2A as an example, the active subset of game items has a total value equal to 7 (i.e., 2+2+3=7). If a base stake was set at 15, and a player wagered 15, the player would be offered a return of 7. However, if the base stake was set at 15, and a player wagered 60 (i.e., four times the base stake), then the player would be offered a return of 28 (i.e., four times the base return).

As mentioned above, the next phase after an initial subset of game items is dealt may begin with offering a player a return based on the initial subset of game items. For example, using row 202 from FIG. 2A as an example, the initial offer would be 8 (i.e., 3+5=8). The initial subset of items cannot be defeated by an immediately previous subset of game items because there is no immediately previous subset of game items and/or the safety subset of game items is not used to defeat an initial subset of game items.

As shown it 118 of FIG. 1, method 100 includes a decision block where it is determined if the player accepts the return. If the player accepts the return, method 100 proceeds to 120, where the player is awarded the return and the press-your-luck challenge ends. A new press-your-luck challenge can then be started by receiving a new stake from a player. If the player declines the return, method 100 loops back to 110, where a subsequent phase of the press-your-luck challenge begins.

Figure 2C:
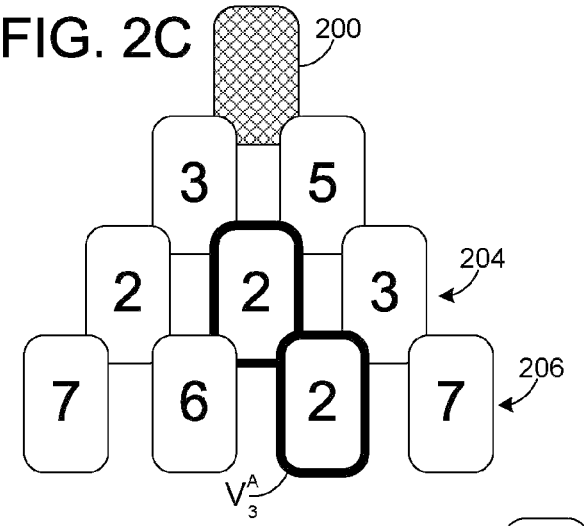

FIG. 2C shows a scenario in which the player does not accept the return, instead opting to gamble for a better return in a subsequent phase of the press-your-luck challenge. While the player may be rewarded with a better return, the next active subset of game items may be defeated by the immediately previous subset of game items, in which case the player loses everything. As such, the player is truly pressing her luck by declining the return.

FIG. 2C shows a next row 206 that becomes the active subset of game items, thus making row 204 the immediately previous subset of game items. Turning back to FIG. 4, at 406 it is determined if, for any value item from the active subset of game items:

$V_t^A = V_t^{A-1}$ or $V_t^A = V_{t-1}^{A-1}$.

In the example of FIG. 2C:

$V_3^A$ is 2 and $V_2^{A-1}$ is 2, so $V_i^A = V_{i-1}^{A-1}$.

Because there is a match, method 400 proceeds to 408, where it is determined if a game item is available from the safety subset of game items. If a game item is not available from the safety subset of game items, method 400 proceeds to 410, and the active subset of game items is defeated by the immediately previous subset of game items. If a game item is available from the safety subset of game items, method 400 proceeds to 412, and the defeated game item from the active subset of game items is replaced with an available game item from the safety subset of game items.

Figure 2D:
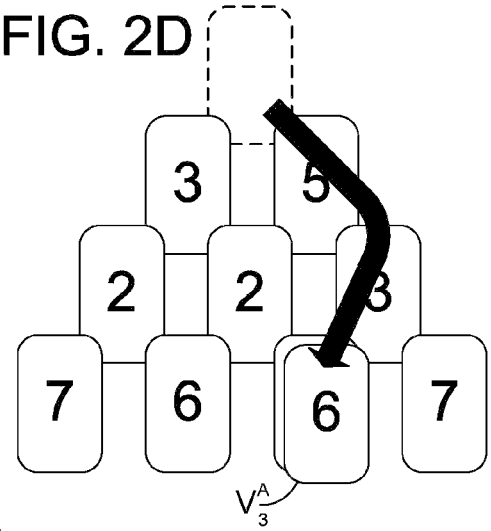

For example, in FIG. 2C, safety card 200 is available. Therefore, card $V_3^A$ is replaced with the safety card. As shown in FIG. 2D, the safety card is a value card having a rank of 6.

Turning back to FIG. 4, method 400 loops back to 406, where it is determined if, for any value item from the active subset of game items:

$V_i^A = V_i^{A-1}$ or $V_i^A = V_{i-1}^{A-1}$.

In the example shown in FIG. 2D, none of the active game items are defeated by relevant game items from the immediately previous subset of game items. In particular, with the substitution of the safety item:

$V_3^A$ is 6 and $V_2^{A-1}$ is 2, so $V_i^A \neq V_{i-1}^{A-1}$.

However, it is to be noted that in some scenarios, a safety item may itself be defeated after replacing a defeated item from the active subset of game items. Further, in some scenarios, a safety item may be a non-value item, such as a savior item that grants immunity to the active subset of game items.

Because none of the active subset of game items are defeated in FIG. 2D, method 400 of FIG. 4 proceeds to 404, and method 100 of FIG. 1 proceeds to 116, where the player is offered a return. In the case of FIG. 2D, the return offered is 26 (i.e., 7+6+6+7=26) assuming the player wagered the base stake.

Figure 5:
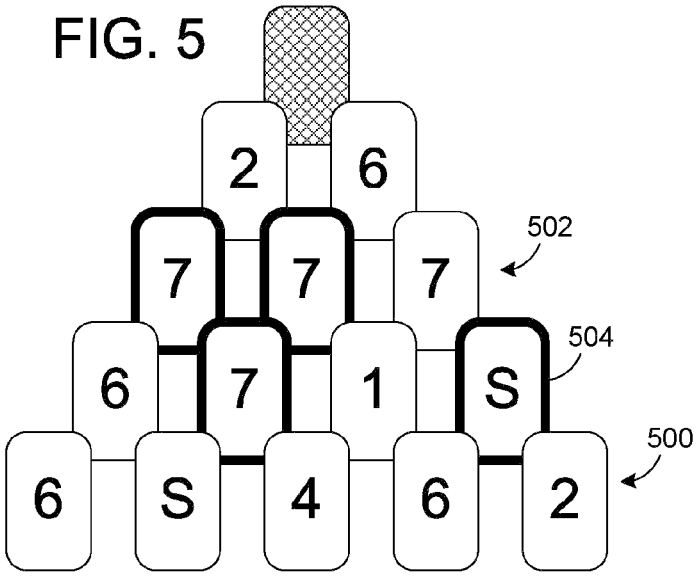
FIG. 5 shows an example scenario in a press-your-luck challenge.

In some variations of a press-your-luck challenge, a return may be augmented with multipliers and/or bonuses. As a nonlimiting example, a player may be awarded a bonus if all value items from any dealt subset of game items have a same rank. In some variations, the bonus can be set to increase the total payout to equal the return multiplied by the number of game items in the subset of game items with all value items having the same rank. For example, FIG. 5 shows a press-your-luck challenge scenario in which a payout of 54 (i.e., (6+null+6+4+2)×3 is offered. In other words, the total of an active subset 500 is multiplied by three because subset 502 includes only value items having the same rank, and in this case there are three such value items. In some variations, if two or more subsets qualify for this bonus, they will be applied cumulatively. In other variations, the larger multiplier will be applied.

FIG. 5 also shows a scenario in which a savior card 504 saved an active subset from defeat.

Figure 6:
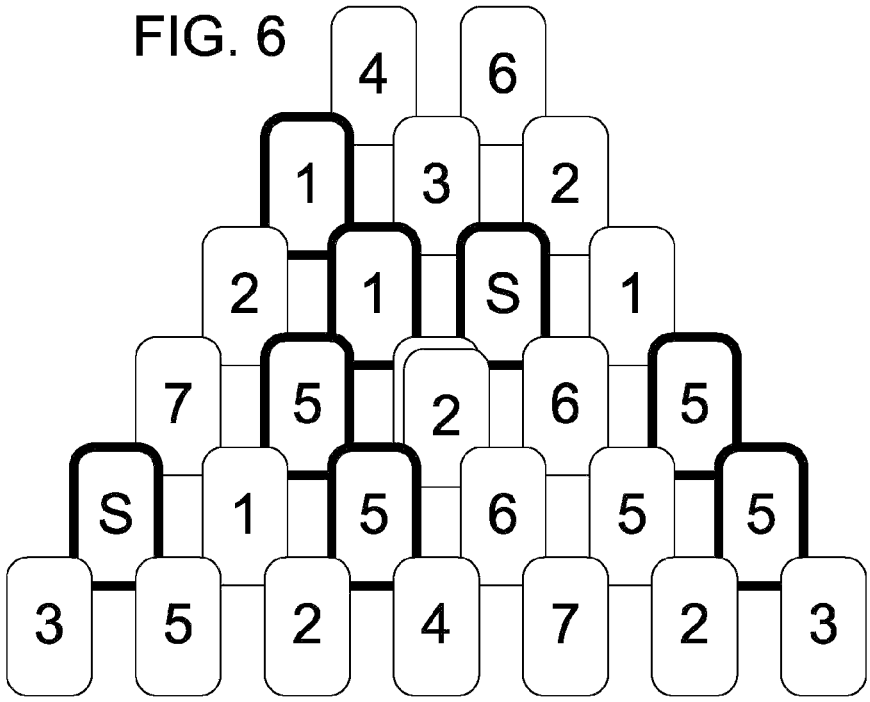
FIG. 6 shows another example scenario in a press-your-luck challenge.

In some variations, a player may be awarded a jackpot if a predetermined number of phases of the press-your-luck challenge have been successfully completed. As a nonlimiting example, if a player survives through a set number of phases, the player may be awarded a total payout that equals the total value of all subsets of game items, not just the active subset of game items. For example, FIG. 6 shows a press-your-luck challenge scenario in which a total payout of 93 (i.e., 4+6+1+3+2+2+1+null+1+7+5+2+6+5+null+1+5+6+5+5+3+5+2+4+7+2+3=93) is offered because the player has been dealt a seventh row of game items without having any active subset of game items defeated by an immediately previous subset of game items. In some variations, the press-your-luck challenge automatically ends when conditions for a jackpot payout are reached, and the player is automatically awarded the jackpot payout. In other variations, a player may have the option of beginning another phase of the press-your-luck challenge, thus risking the jackpot payout.

FIG. 6 also shows how savior cards in two different rows saved two different active subsets from defeat. In FIG. 6, a safety card was also used to save an active subset from defeat.

In some variations of a press-your-luck challenge, the full set of game items may include one or more death items. In such variations, an active subset of game items that includes a death item is automatically defeated. However, some variations may allow a safety item to replace a death item and/or a savior item to trump a death item.

In some variations of a press-your-luck challenge, the full set of game items may include one or more peek items. In such variations, a player is allowed to learn a game item from the safety subset of game items if an active subset of game items includes a peek item. As an example, if a player is dealt a peek item, the player may turn a face-down safety card face-up.

In some variations of a press-your-luck challenge, the full set of game items may include one or more multiplier items. One example type of multiplier item multiplies the return by a predetermined number (e.g., 2) if the multiplier item is in the active subset of game items. Such a multiplier may be cumulative to other bonuses, such as jackpot or a bonus given for having a subset of game items that all have the same rank. Such a multiplier may be applied to the return even if the subset in which the multiplier item appears would not otherwise be used to calculate the return. Another example type of multiplier item multiplies the total value of the subset in which that multiplier item appears. Such a multiplier may only be applied to the return if the subset in which the multiplier item appears is used to calculate the return (e.g., the subset is the active subset or a jackpot is awarded).

Figure 7:
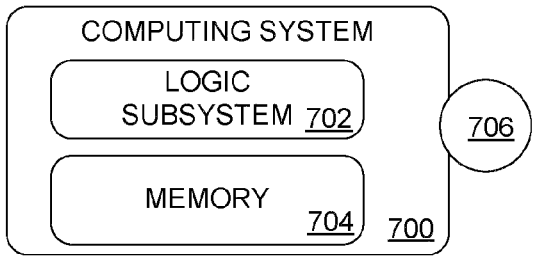
FIG. 7 schematically shows a computing system configured to host a press-your-luck challenge in accordance with an embodiment of the present disclosure.

In some embodiments, a press-your-luck challenge in accordance with the present disclosure may be hosted by a variety of different computing devices. FIG. 7 schematically shows a computing device 700 that may host a press-your-luck challenge. Computing device 700 includes a logic subsystem 702 and memory 704.

Logic subsystem 702 may include one or more physical devices configured to execute one or more instructions. For example, the logic subsystem may be configured to execute one or more instructions that are part of one or more programs, routines, objects, components, data structures, or other logical constructs. Such instructions may be implemented to perform a task, implement a data type, change the state of one or more devices, or otherwise arrive at a desired result. The logic subsystem may include one or more processors that are configured to execute software instructions. Additionally or alternatively, the logic subsystem may include one or more hardware or firmware logic machines configured to execute hardware or firmware instructions. The logic subsystem may optionally include individual components that are distributed throughout two or more devices, which may be remotely located in some embodiments.

Memory 704 may include one or more physical devices configured to hold data and/or instructions that, when executed by the logic subsystem, cause the logic subsystem to implement the herein described methods and processes. Memory 704 may include removable media and/or built-in devices. Memory 704 may include optical memory devices, semiconductor memory devices, and/or magnetic memory devices, among others. Memory 704 may include portions with one or more of the following characteristics: volatile, nonvolatile, dynamic, static, read/write, read-only, random access, sequential access, location addressable, file addressable, and content addressable. In some embodiments, Logic subsystem 702 and memory 704 may be integrated into one or more common devices, such as a system-on-a-chip or an application specific integrated circuit.

FIG. 7 also shows memory in the form of removable media 706, which may be used to store and/or transfer instructions that, when executed, perform the herein described methods and processes.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of the above-described processes may be changed.

The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. Memory holding executable instructions that, when executed by a logic subsystem, cause a computing system to:

receive a stake from a player;

deal an initial subset of incrementally indexed game items from a set of game items including a plurality of ranked value items; and then iteratively begin a new phase of a press-your-luck challenge, each phase comprising:

dealing an active subset of incrementally indexed game items from the set of game items such that a subset of game items that was dealt immediately prior to the new phase becomes an immediately previous subset of game items, where the active subset of game items is defeated by the immediately previous subset of game items if, for any value item from the active subset of game items, that value item has a rank that is equal to a rank of a value item from the immediately previous subset of name items having an index equal-to or one-less-than an index of that value item;

if the active subset of game items is defeated by the immediately previous subset of game items, ending the press-your-luck challenge;

if the active subset of game items is not defeated by the immediately previous subset of game items, offering the player a return equal to a total value of the active subset of game items;

if the player accepts the return, awarding the player the return and ending the press-your-luck challenge; and if the player declines the return, beginning a subsequent phase of the press-your-luck challenge.

2. The memory of claim 1, further holding executable instructions that, when executed by the logic subsystem, cause the computing system to deal a safety subset of game items; and if a game item is available from the safety subset of game items; and if, for any value item from the active subset of game items, that value item has a rank that is equal to a rank of a value item from the immediately previous subset of game items having an index equal-to or one-less-than an index of that value item;

then replacing that value item from the active subset of game items with a game item from the safety subset of game items.

3. The memory of claim 2, further holding executable instructions that, when executed by the logic subsystem, cause the computing system to allow the player to learn a game item from the safety subset of game items if the active subset of game items includes a peek item, where the set of game items includes one or more peek items.

4. The memory of claim 1, where each value item from the active subset of game items has an individual value equal to the rank of that value item, and where the total value of the active subset of game items is a sum of the individual values for all value items from the active subset of game items.

5. The memory of claim 1, further holding executable instructions that, when executed by the logic subsystem, cause the computing system to award the player a bonus upon awarding the player the return if all value items from a subset of game items have a same rank.

6. The memory of claim 1, further holding executable instructions that, when executed by the logic subsystem, cause the computing system to award the player a jackpot upon awarding the player the return if a predetermined number of phases of the press-your-luck challenge have been completed.

7. The memory of claim 1, where the set of game items includes one or more savior items, and where an active subset of game items that includes a savior item is immune from defeat.

8. The memory of claim 1, where the set of game items includes one or more death items, and where an active subset of game items that includes a death item is automatically defeated.

9. The memory of claim 1, where the set of game items includes one or more multiplier items, and where a bonus is awarded upon awarding the player the return if a multiplier item has been dealt.

10. The memory of claim 1, where the set of game items includes one or more multiplier items, and where a bonus is awarded upon awarding the player the return if the active subset of game items includes a multiplier item.

11. The memory of claim 1, where each active subset of game items includes one more game item than an immediately previous subset of game items.

12. The memory of claim 1, further holding executable instructions that, when executed by the logic subsystem, cause the computing system to randomize an order of the set of game items.

13. The memory of claim 1, where a return bonus is increased proportional to the stake.

14. A computer server for hosting games to be played on a remote computing device, the computer server comprising memory holding executable instructions that, when served to the remote computing device for execution by the remote computing device, cause the remote computing device to:

receive a stake from a player;

deal an initial subset of incrementally indexed game items from a set of game items including a plurality of ranked value items; and then iteratively begin a phase of a press-your-luck challenge, each phase comprising:

dealing an active subset of incrementally indexed game items from the set of game items such that a subset of game items that was dealt immediately prior to the new phase becomes an immediately previous subset of game items, where the active subset of game items is defeated by the immediately previous subset of game items if, for any value item from the active subset of game items, that value item has a rank that is equal to a rank of a value item from the immediately previous subset of game items having an index equal-to or one-less-than an index of that value item;

if the active subset of game items is defeated by the immediately previous subset of game items, ending the press-your-luck challenge;

if the active subset of game items is not defeated by the immediately previous subset of game items, offering the player a return equal to a total value of the active subset of game items;

if the player accepts the return, awarding the player the return and ending the press-your-luck challenge; and if the player declines the return, beginning a subsequent phase of the press-your-luck challenge.

15. The computer server of claim 14, wherein the memory further holds executable instructions that, when served to the remote computing device for execution by the remote computing device, cause the remote computing device to deal a safety subset of game items; and if a game item is available from the safety subset of game items; and if, for any value item from the active subset of game items, that value item has a rank that is equal to a rank of a value item from the immediately previous subset of game items having an index equal-to or one-less-than an index of that value item;

then replacing that value item from the active subset of game items with a game item from the safety subset of game items.

16. The computer server of claim 15, wherein the memory further holds executable instructions that, when served to the remote computing device for execution by the remote computing device, cause the remote computing device to allow the player to learn a game item from the safety subset of game items if the active subset of game items includes a peek item, where the set of game items includes one or more peek items.

17. The computer server of claim 14, where each value item from the active subset of game items has an individual value equal to the rank of that value item, and where the total value of the active subset of game items is a sum of the individual values for all value items from the active subset of game items.

18. The computer server of claim 14, where the set of game items includes one or more savior items, and where an active subset of game items that includes a savior item is immune from defeat.

19. The computer server of claim 14, where the set of game items includes one or more death items, and where an active subset of game items that includes a death item is automatically defeated.

20. The computer server of claim 14, where each active subset of game items includes one more game item than an immediately previous subset of game items.

* * * * *